United States Patent [19]

Katakabe et al.

[11] 4,176,940

[45] Dec. 4, 1979

[54] ELECTROPHOTOGRAPHIC COLOR IMAGE PRODUCING APPARATUS

[75] Inventors: Noboru Katakabe, Katano; Isao Yamaguchi, Yawata; Masaru Onishi, Neyagawa, all of Japan

[73] Assignee: Matsushita Electric Industrial Co., Ltd., Osaka, Japan

[21] Appl. No.: 882,951

[22] Filed: Feb. 28, 1978

[30] Foreign Application Priority Data

Mar. 9, 1977 [JP] Japan ..... 52-26514

[51] Int. Cl.[2] ..... G03G 15/10

[52] U.S. Cl. ..... 355/10; 118/661; 354/317; 355/4; 430/42

[58] Field of Search ..... 355/4, 10; 354/317, 354/318; 118/645, 661; 427/15, 18

[56] References Cited

U.S. PATENT DOCUMENTS

| | | | |
|---|---|---|---|
| 3,694,069 | 9/1972 | Yamaji et al. | 355/4 |
| 3,795,917 | 3/1974 | Yamaji et al. | 355/4 |
| 3,797,930 | 3/1974 | Tanaka et al. | 355/4 |
| 3,848,989 | 11/1974 | Yamaji et al. | 355/4 |
| 3,945,727 | 3/1976 | Nakajima et al. | 355/10 |
| 3,964,828 | 6/1976 | Yamada | 355/10 |
| 3,972,609 | 8/1976 | Pfeifer et al. | 355/4 |

*Primary Examiner*—R. L. Moses

*Attorney, Agent, or Firm*—Wenderoth, Lind & Ponack

[57] ABSTRACT

An apparatus in which a charger, three developer units and a dryer are mounted on a table reciprocally movable relative to an electrophotographic film for subjecting the film to three cycles of processing each constituting charging, exposing, developing and drying in this recited order so as to produce a color image on the film. The developer units to be operated for the respective cycles are switched by shifting the position of the developer operating means relative to the position of the developer units by the movement of the table. Thereby, a color image can be automatically obtained yet the apparatus is compact and simple in construction.

18 Claims, 17 Drawing Figures

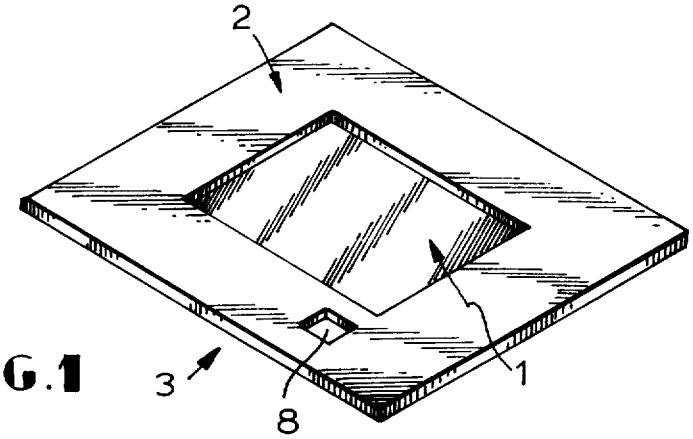
FIG. 1
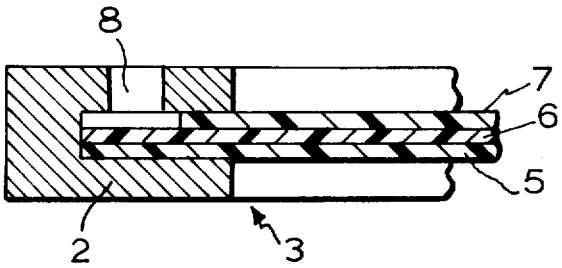
FIG. 2
FIG. 3
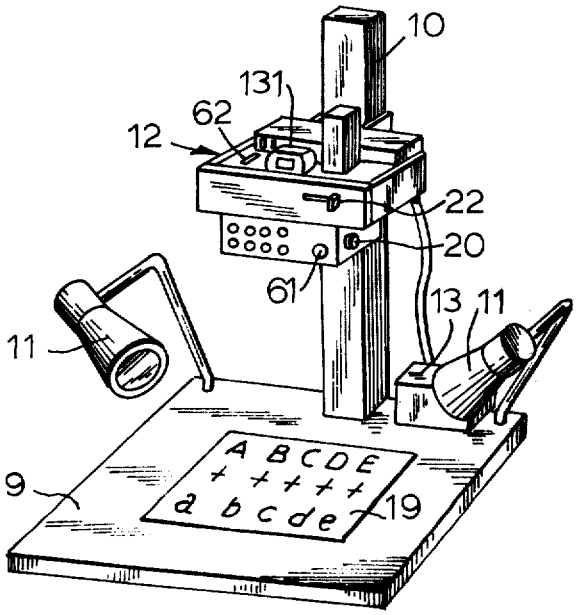

ELECTROPHOTOGRAPHIC COLOR IMAGE PRODUCING APPARATUS

This invention relates to an electrophotographic color image producing apparatus for automatically producing on an electrophotographic film, such as a slide film, a color image of an original, particularly a full-color image.

Various apparatus are known for producing an image of an original on an electrophotographic film such as an electrophotographic slide film mounted in a slide mount. U.S. Pat. No. 3,945,727 teaches such apparatus for producing a mono-color image on an electrophotographic film in a slide mount, which film uses a transparent organic photoconductor such as polyvinylcarbazole.

Also known is a color image producing apparatus for producing a full-color image on an electrophotographic film by subjecting the film to three cycles of image processing using three liquid developers for yellow, magenta and cyan, respectively, with the three primary color images being superposed on each other. However, such apparatus is complicated in construction, large in size and expensive. Further, in some such apparatus, the primary color images cannot be superposed exactly on each other, resulting in an unclear image.

Accordingly, it is an object of this invention to provide an electrophotographic color image producing apparatus which is simple in construction and can produce a color image by a simple operation.

Another object of this invention is to provide an apparatus which can produce a clear and high-fidelity color image.

A further object of this invention is to provide an apparatus which can produce a color image on a film preliminarily mounted in a film mount, without staining the mount with liquid developers.

A still further object of this invention is to provide an apparatus which has a processing table having a plurality of n developer units mounted thereon, wherein the processing table is reciprocally moved in n cycles, and the developer units to be operated are sequentially switched for the sequential reciprocal movement cycles, respectively, for automatically producing a color image on an electrophotographic film.

These objects are achieved according to this invention by providing an electrophotographic color image producing apparatus for producing on an electrophotographic film a color image of an original, comprising:

a housing;

film unit holding means supported by said housing for holding at a processing position a film unit comprising an electrophotographic film having a major surface facing downwards;

processing means arranged in said housing for processing an image on said major surface of said film, said processing means comprising a charger for applying a uniform electrostatic charge on said major surface of said film, an exposure unit for applying light from an original to the charge-bearing major surface of said film to form a latent image, n developer units (n being an integer larger than 1) each containing a liquid developer for developing said latent image to a visible image, and a dryer for drying the visible image-bearing major surface of said film, said exposure unit including a lens unit supported by said housing for focusing said light from the original on said charge-bearing major surface of said film;

a processor table slidably mounted in said housing and reciprocally movable along a horizontal path under said major surface of said film between a first position and a second position, said processor table having said dryer, said plural developer units and said charger mounted thereon in this recited order in the direction from said first position to said second position so that each of said charger, said plural developer units and said dryer passes said processing position for said film unit in this recited order upon the movement of said processor table for performing the charging step, the exposing step, the developing step and the drying step at said processing position in this recited order;

driving means coupled to said processor table for reciprocally moving said processor table between said first position and said second position; and developer operating means for being selectively coupled to the mth one of said n developer units (m being an integer defined by $1 \leqq n \leqq m$) for operating said mth developer unit to apply said liquid developer in said mth developer unit to said major surface of said film when said mth developer unit is positioned at said processing position in an mth reciprocal movement of said processor table, and in one reciprocal movement of said processor table, for being released from said mth developer unit, and for being coupled to an $(m+1)$th developer unit for operating said $(m+1)$th developer unit to apply said liquid developer in said $(m+1)$th developer unit to said major surface of said film when said $(m+1)$th developer unit is positioned at said processing position in an $(m+1)$th reciprocal movement of said processor table;

whereby during n reciprocal movements of said processor table between said first and second position, n cycles each constituting a charging step, an exposing step, a developing step and a drying step are performed for the respective liquid developers in said n developer units for producing a color image on said major surface of said film.

These and other objects and the features of this invention will be apparent upon considering the following detailed description taken together with the accompanying drawings, in which:

FIG. 1 is a perspective view of an example of an electrophotographic film mounted in a film mount which can be used in an apparatus of this invention;

FIG. 2 is a cross-sectional view of a portion of the film and the film mount of FIG. 1;

FIG. 3 is a perspective view of an embodiment of the system using an embodiment of the electrophotographic color image producing apparatus of this invention;

Figure 4:
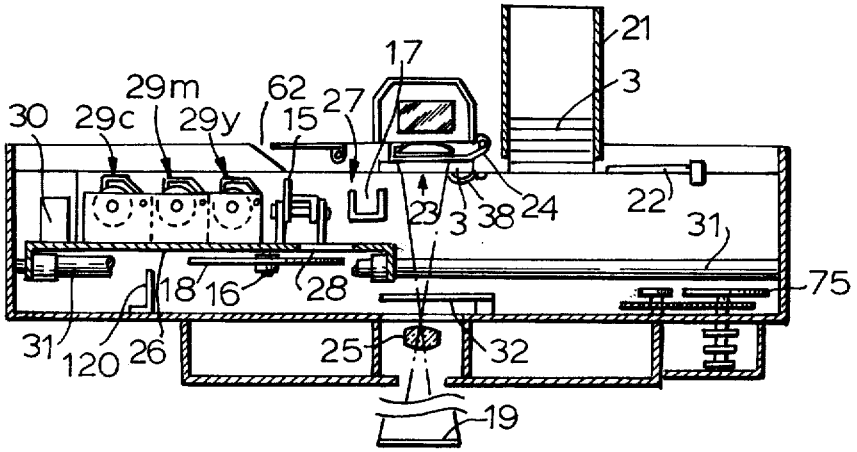
FIG. 4 is a front view, mainly in cross-section, of the apparatus of FIG. 3.
Figure 11:
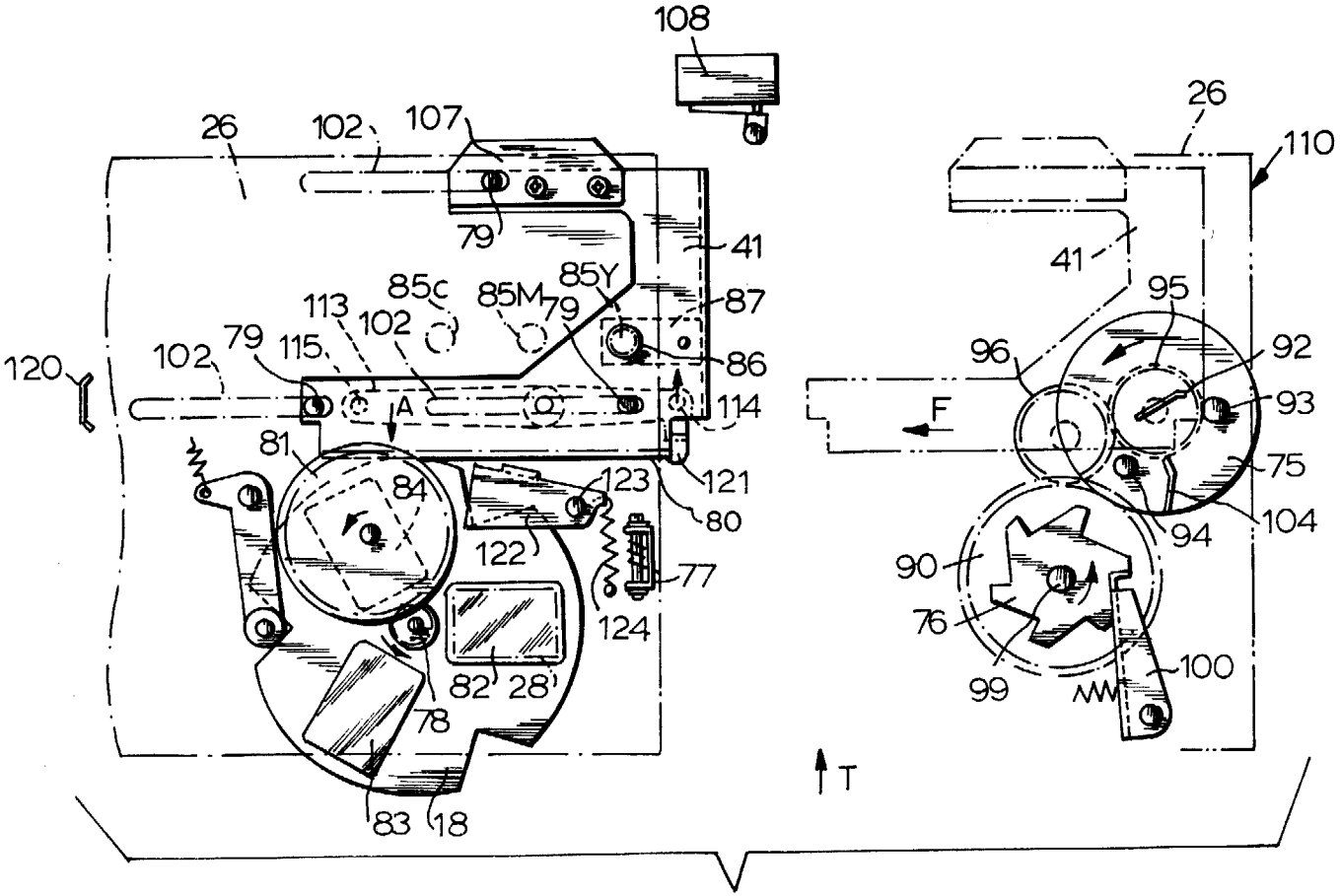
FIG. 11 is a top plan view of a portion of the apparatus of FIG. 4 for explaining the operation thereof.
Figure 12:
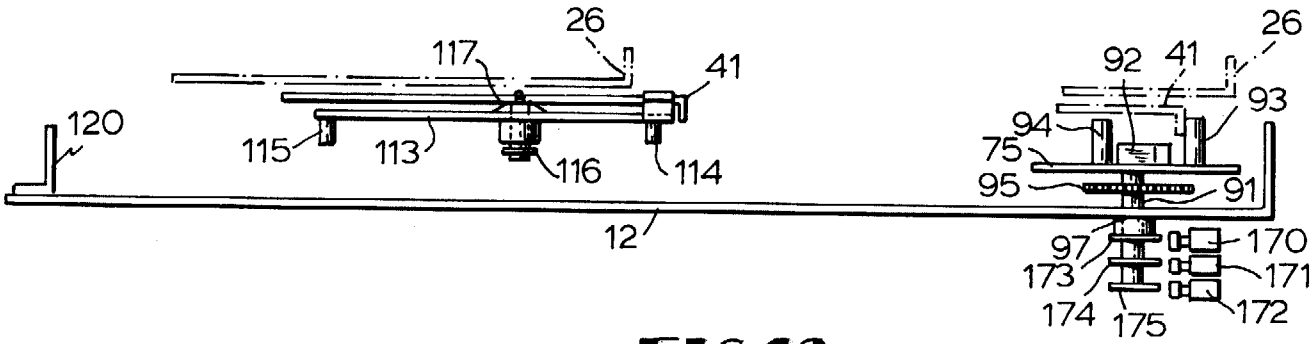
Figure 13:
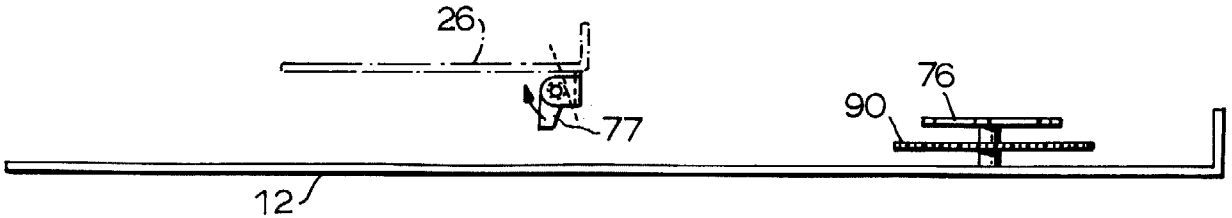
Figure 14:
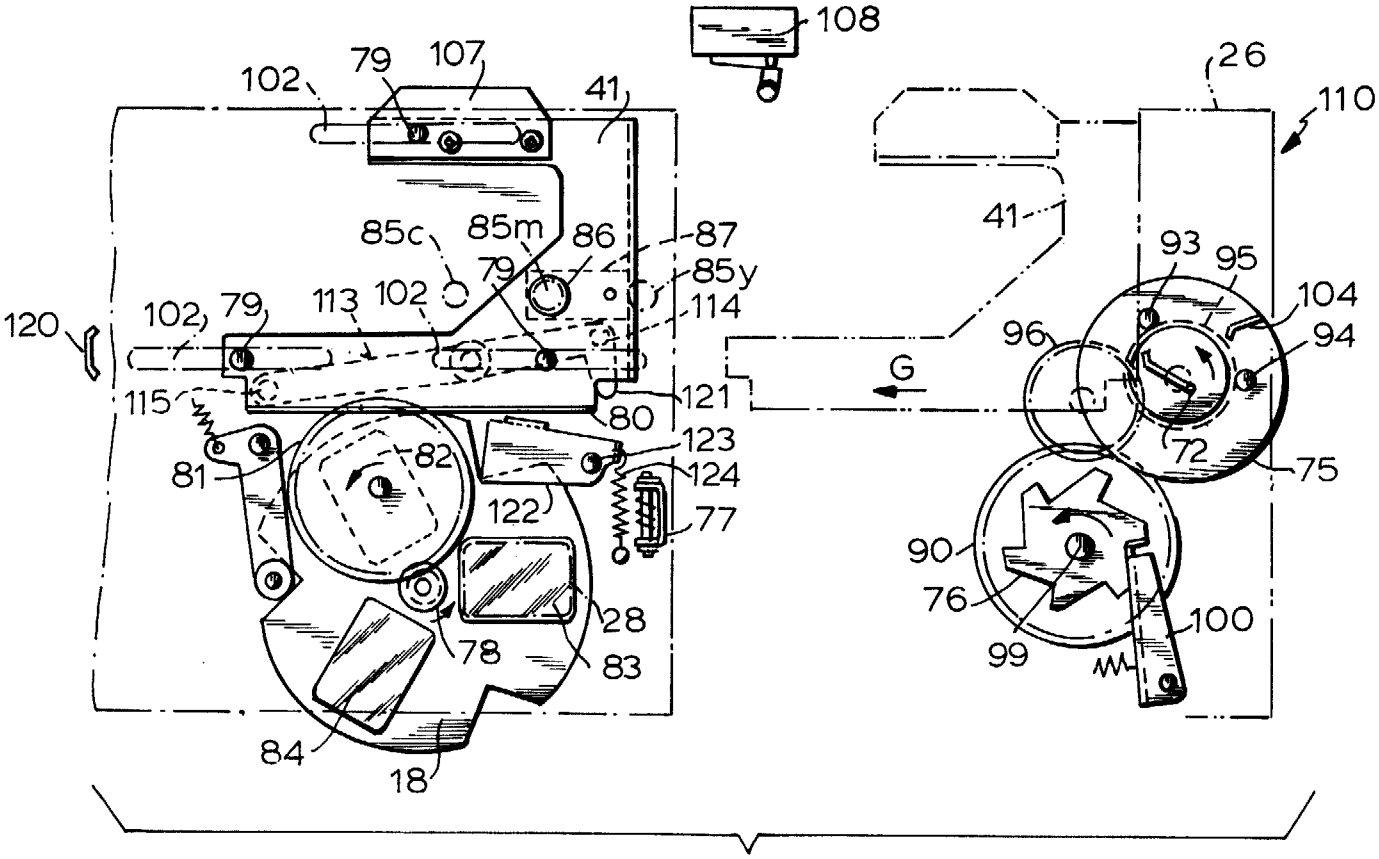
Figure 15:
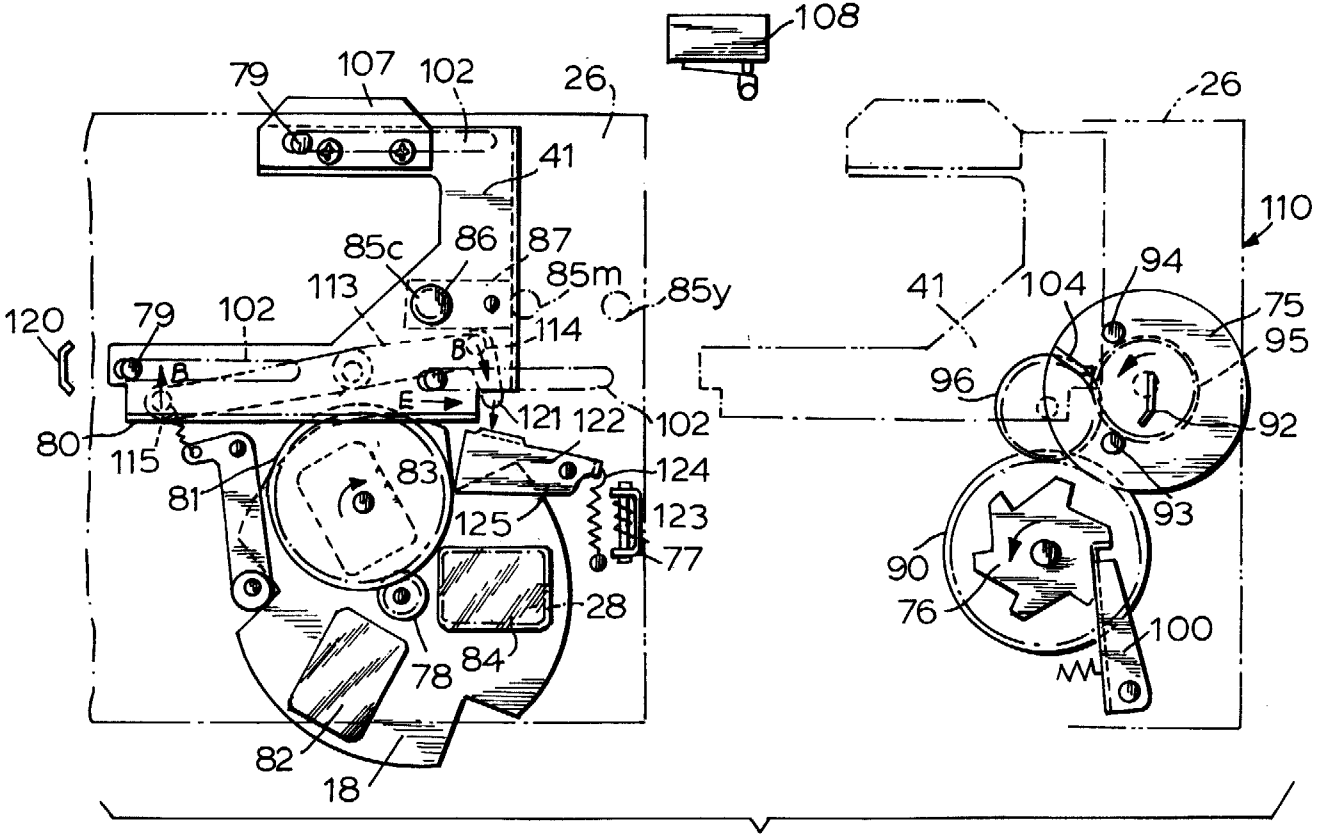
Figure 16:
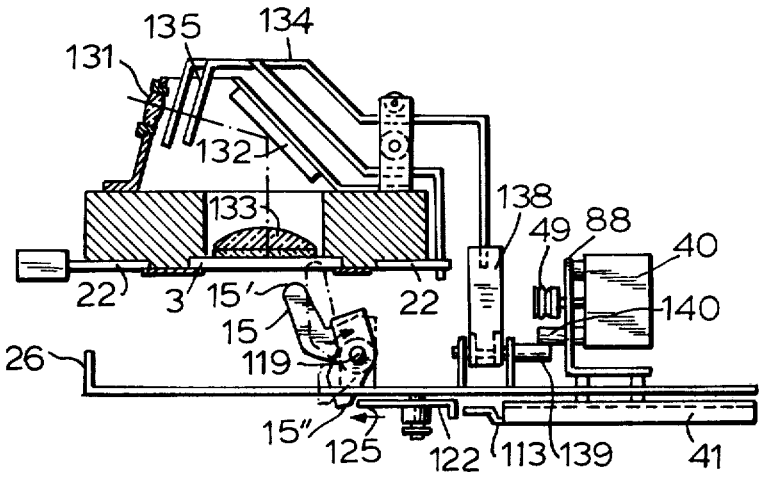
Figure 17:
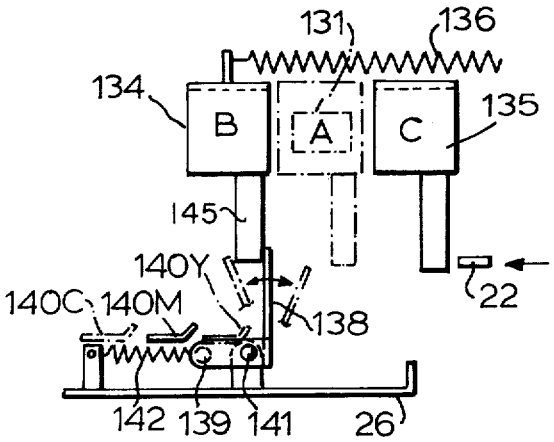

Each of FIGS. 12 and 13 is a front view of a portion of the apparatus of FIG. 4 for explaining the further operation thereof;

Each of FIGS. 14 and 15 is a top plane view of a portion of the apparatus of FIG. 4 corresponding to FIG. 11 for explaining the further operation thereof;

FIG. 16 is a side view, partly in cross-section, of a finder member usable in the apparatus of FIG. 4; and FIG. 17 is a schematic drawing for explaining the operation of finder covers usable in the apparatus of FIG. 4.

In the drawings, similar elements are designated by similar reference numerals.

Referring to FIG. 1, an example of a film with a film mount usable in the apparatus of this invention comprises a slide film unit 3 comprising an electrophotographic film 1 preliminarily mounted in a slide mount 2 made e.g. of a paper or a synthetic resin. The slide mount 2 has a size e.g. of 50 mm×50 mm with a thickness of 2 mm, and has an aperture e.g. of 34 mm×23 mm. As shown in FIG. 2, the film 1 which is preferably transparent comprises a base film 5 e.g. of polyethylene terephthalate having thereon a transparent and conductive layer 6 e.g. of copper iodide or evaporated palladium which in turn has thereon a photoconductive layer 7 e.g. of an organic photoconductive material such as polyvinylcarbazole. The photoconductive layer 7 is not coated on whole the surface of the conductive layer 6 but exposes a portion of the conductive layer 6 at a window 8. Thus, a grounding electrode can be contacted to the conductive layer 6 through the window 8.

Referring now to FIG. 3, a main apparatus portion 12 is slidably mounted on a column 10 which is fixed to a base plate 9 on which an original 19 to be copied is to be placed. Lamps 11 are supported by the base plate 9 for applying light onto the original 19 placed on the base plate. On the base plate, furthermore, a control box 13 containing an electrical circuit for controlling the apparatus is mounted, and is electrically connected to the apparatus 12 by a connecting cable. For producing a color image on the slide film 1, the vertical position of the apparatus 12 is adjusted to select a desired size of the image of the original to be copied on the film 1, and the image to be copied is focused by a knob 20. Then, by pressing a feeder lever 22, a film unit is fed to a film unit holding means at a processing position. By pressing a start switch 61, the apparatus starts operating, and finally the film unit having an automatically produced color image is automatically brought to an outlet 62.

Referring to FIG. 4, a plurality of film units 3 ready to be subjected to image processing are stacked in a film magazine 21. To feed a film unit 3 to a processing position 23, a film feed lever 22 is manually moved leftward. The thus fed film unit 3 is held at the processing position 23 by a pressure plate 24, with the photoconductive layer facing downwards. A lens 25 is arranged to project therethrough an image from the original 19 onto the photoconductive layer 7 of the film 1. The conductive layer 6 of the thus held film 1 is contacted to a grounding resilient plate 38 through the window 8 of the film mount 2 for grounding the conductive layer 6. The resilient plate 38 is a metal plate and is secured at an end portion thereof to a part of a housing of the apparatus defining a guiding path for guiding the film unit 3 to the processing position. Therefore, the conductive layer 6 is held at an equal potential with the potential of the apparatus.

The leading edge portion of the resilient plate which is to contact the conductive layer 6 slides on the surface of the film mount 2 relative to the movement of the film unit 3 when the film unit 3 is fed by the feeder lever 22 from the film magazine 21 to the processing position and when the film unit 3 is fed out by a film kicker 15 from the processing position 23 to the outlet 62. Therefore, the photoconductive layer 7 of the film 1 is not damaged by the resilient plate 38.

Figure 5:
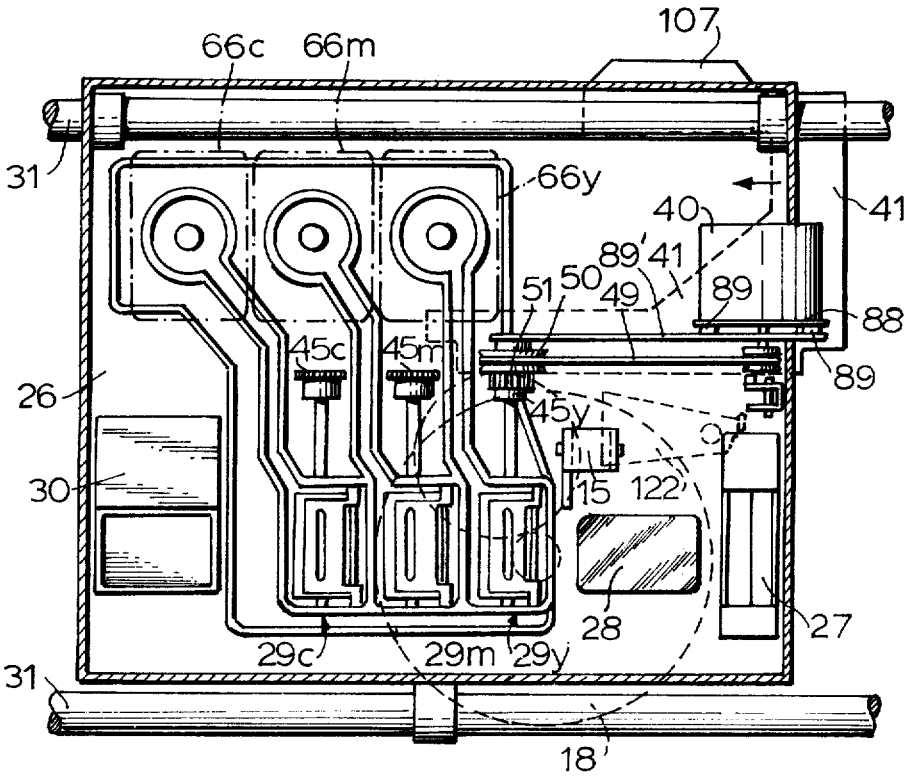
FIG. 5 is a top plan view, partly in cross-section, of a main portion of the apparatus of FIG. 4.

In the housing of the apparatus a processor table 26 having mounted thereon a processor means for electrophotographically processing an image on the film 1. The processor table is slidably mounted on guide rods 31 to move horizontally. The film 1 at the processor position 23 is positioned to face the path of movement of the processing means. The processor table 26 is arranged to be movable between a leftmost position (first position) as shown in FIG. 4 and a rightmost position (second position) on the guide rods 31 as understandable from FIG. 4. As shown in FIGS. 4 and 5, on the processor table 26 are mounted a charger 27, three developer units 29Y, 29M and 29C, a dryer 30 and a filter disk. The processor table 26 has an exposure window 28 therein. The filter disk 18 has provided thereon a blue filter 82, a green filter 83 and a red filter 84 each having a size large enough to cover the exposure window 28. Upon exposure, the light image of the original coming through the lens 25 passes through one of the three filters 82, 83, 84 which is positioned below the exposure window 28 to cover the exposure window 28, and then the light image is projected onto the film 1 held at the processing position 23 through the filter.

The charger 27 comprises a tungsten wire 17 for corona discharging and a shield plate to shield the sides of the tungsten wire 27 to block unwanted discharge. For charging, a d.c. voltage of about −4.5 kV is applied to the tungsten wire 17. The developer units 29Y, 29M, 29C are arranged on the processor table 26 near the exposure window 28 in this recited order with the developer unit 29Y being nearest to the exposure window 28. The developer units 29Y, 29M, 29C comprise containers, respectively, to contain yellow, magenta and cyan liquid developers, respectively. The dryer 30 comprises a heater and a fan, and applies hot air onto the film 1 for drying out residual liquid developer on the film 1 at the processing position 23 when the dryer 30 moving together with the processor table 26 is positioned under the film 1.

In general, for producing a full-color image electrophotographically, it is preferable to subject an electrophotographic film to three electrophotographic processing cycles: a first cycle comprising (a) a charging step, (b) a selective light exposure through a blue filter, (c) a developing step using a yellow liquid developer, and (d) a drying step; a second cycle comprising (a) a charging step, (b) a selective light exposure through a green filter, (c) a developing step using a magenta liquid developer, and (d) a drying step; and a third cycle comprising (a) a charging step, (b) a selective light exposure through a red filter, (c) a developing step using a cyan liquid developer, and (d) a drying step. The apparatus of this invention performs these three processing cycles as will be described below.

When the film unit 3 is fed to the processing position 23 as described above, the processor table 26 positioned at the position shown in FIG. 4 starts moving rightward. The position where the processor table thus starts its movement is referred to as a first position. When the charger 27 is brought to the position under the film 1 by the movement of the processor table 26, the tungsten wire 17 is supplied with a voltage of about −4.5 kV so as to produce corona discharging, by which the film 1 is supplied with an electrostatic charge of a negative polarity. Under the exposure window 28 is a filter disk 18 rotatable an a shaft 16 fixed on the processor table 26. When the exposure window 28 is brought to the position under the film 1 at the processing position 23, the processor table 26 is stopped, and a shutter 32 for shutting the light from the original 19 is opened. The shutter 32 is designed to be closed when a film unit 32 is fed into the processing position from the film magazine 21, by detecting the feed-in of the film unit 32.

At this moment, a blue filter provided on the filter disk 18 is positioned below the exposure window 28, so that the light image from the original 19 is projected onto the film 1 (major surface or photoconductive surface of the film 1) through the lens 25, the blue filter and the exposure window 28. Thus, the light image then applied to the film 1 is that due to the light coming through a blue filter. The shutter 32 is kept open until a clear latent image (charge image) corresponding to the light is formed on the film 1 during a sufficient exposure period. Then, the shutter 32 is closed, and the processor table 26 again starts moving rightward.

When the developer unit 29Y is brought to the position under the film 1 by the movement of the processor table 26, the developer unit 29Y starts operating to rise the level of the yellow liquid developer contained therein for developing the latent image by the yellow liquid developer. When the processor table 26 further moves rightward, the developer unit 29Y stops its operation, so that the level of the yellow liquid developer in the developer unit 29Y falls to the original level, and then the dryer 30 is brought to the position under the film 1 by the movement of the processor table 1. There, the processor table 26 stops its movement again. The position where the processor table 26 thus stops its movement is referred to as a second position. The dryer 30 applies hot air to the image-developed film 1 when the dryer 30 is positioned under the film 1, so as to dry the film 1 which has been wet with the yellow liquid developer.

According to a specific example of the apparatus of this invention, the dryer 30 first produces hot air of 60° C. for a predetermined period, and then room temperature air for the remaining period. This room temperature air is provided for enabling higher voltage charging in the subsequent processing cycle, because when the temperature of the film is higher, the voltage of the charge applicable to the film is lower. In the case of this example of this invention in which light is passed through a green filter in a subsequent processing cycle after the developing by the yellow liquid developer, it is preferred that the charging conditions in the processing cycles be equalized. The room temperature air from the dryer can achieve this equalization. This also applies to the drying after the development by the magenta liquid developer.

After the drying step in the first processing cycle, the processor table 26 starts moving backward (leftward) and returns to the initial start position (first position) as shown in FIG. 4, where the processor table 26 again starts moving rightward. This is the start of a second processing cycle. Just as in the case of the first cycle, the film 1 is then supplied with a charge by the tungsten wire 17. The processor table 26 moves rightward until the exposure window 28 is positioned under the film. Then the processor table 26 stops, and the shutter 32 opens to permit exposure. Before the shutter 32 opens, the blue filter which has been positioned under the exposure window 28 in the first processing cycle is replaced by the green filter by the rotation of the filter disk 18 before the opening of the shutter by a mechanism of the apparatus which will be described later in detail. Therefore, in this second processing cycle, the light image from the original 19 is projected onto the film 1 through the lens 25, the green filter and the exposure window 28 so as to produce a latent image corresponding to the light image coming through the green filter.

After the exposure, the developer unit 29M is operated, after the developer unit 29M is positioned under the film 1 by the movement of the processing table 26, so as to raise the level of the magenta liquid developer therein and thus to contact the magenta liquid developer with the latent-image-bearing film surface. After the developing step, the drying step is performed just as in the case of the first processing cycle. Thereafter, the processing table 26 returns leftward to the first position, where the processor table 26 again starts moving rightward to start the third processing cycle. The third processing cycle is performed in the same manner as in the case of the second processing cycle, except that in the third processing cycle the red filter is used instead of the green filter, and the developer unit 29C is operated instead of the developer unit 29M. Upon the return movement of the processor table 26 from the second position to the first position, the film kicker 15 is pushed up by a mechanism of the apparatus which will be described later in detail, and abuts the right side end of the film unit 3, so as to push the film unit leftward during the return movement of the processor table 26 thus to kick the film unit 3 to the outlet 62.

As apparent from the above description, by one reciprocal movement of the processor table 26 between the first and the second position, one processing cycle of charging, exposing, developing and drying is performed. And by carrying out three reciprocal movements while using three color filters and three color liquid developers for the three reciprocal movements, respectively, three processing cycles are performed. Since according to the apparatus described above, the film unit 3 is fixed in the processing position while the processing table 26 with a charger, an exposure unit and developer units moves to produce an image on the film 1, the light image from the original 19 is always projected onto the same position on the film 1 throughout the three reciprocal movements of the table 26. Therefore, exact superposition of three color light images, which is difficult to achieve in this kind of apparatus, can be achieved.

Figure 6:
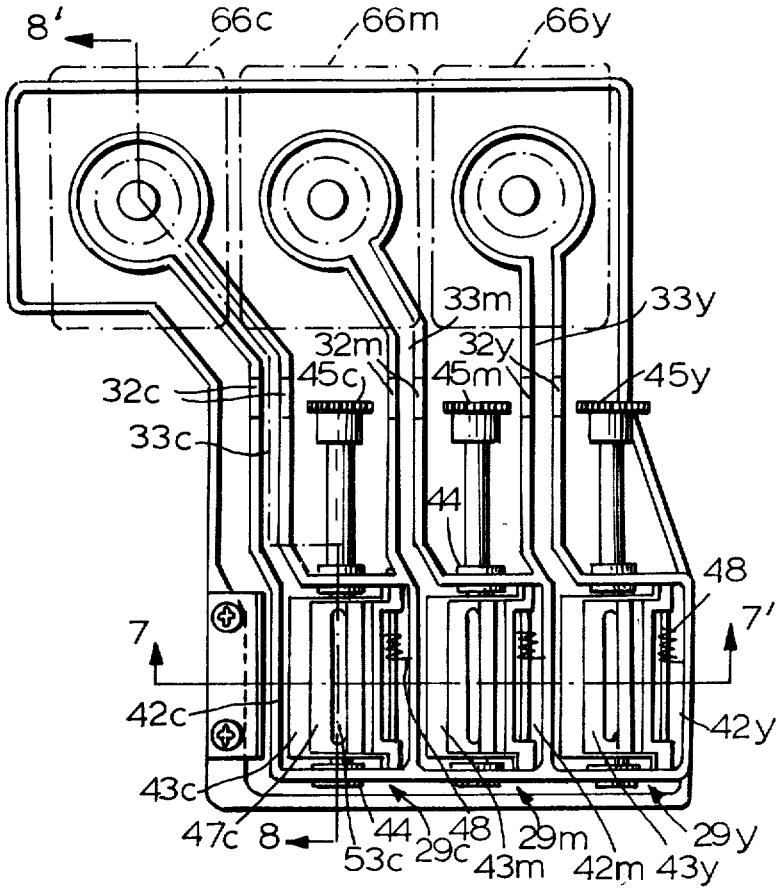
FIG. 6 is a top plan view of plural developer units used in the apparatus of FIG. 4.
Figure 7:
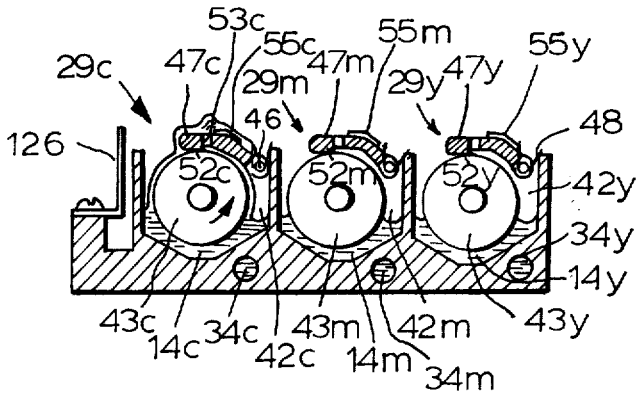
FIG. 7 is a cross-sectional view taken along the line 7—7' of FIG. 6.

Referring to FIG. 5 et seq of the drawings, a main portion of an embodiment of the apparatus according to this invention, particularly the developer units, will be described in detail. FIGS. 5 and 7 show states where the developer units 29Y and 29C are operated, respectively. Referring to FIGS. 6 and 7, the developer units 29Y, 29M, 29C comprise a yellow liquid developer container 42Y containing a yellow liquid developer 14Y, a magenta liquid developer container 42M containing a magenta liquid developer 14M, and a cyan liquid developer container 42C containing a cyan liquid developer 14C. The containers 42Y, 42M, 42C are separated so as to prevent mixing of the liquid developers 14Y, 14M, 14C. In the embodiment shown herein, a common partition wall is used between each adjacent containers, and the three containers are integrated as one device.

Hereinafter, the construction and the operation of the cyan developer unit 29C will be described. The construction and the operation of the other developer units 29Y and 29M are similar to the developer unit 29C. As to the developer unit 29C, a developer roller 43C is rotatably mounted in the container 42C in bearings 44. One end of the rotational shaft of the roller 43C protrudes out of the container 42C, and has a gear 45C fixed thereto. In the container 42C is an overflow means 47C pivotallly fixed to the container 42C on a pivot 46. The overflow means 47C is gently urged against the roller 43C by a torsion spring 48 provided on the pivot 46 of the overflow means 47C, so that the edge portion 52C of the overflow means 47C is in contact with the roller 43C.

Figure 10:
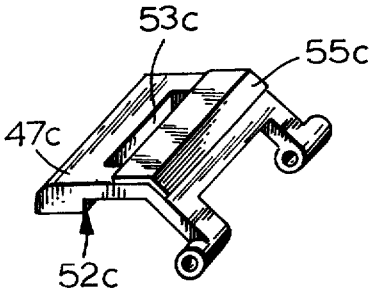
FIG. 10 is a perspective view of an overflow means usable in each developer unit in the apparatus of FIG. 4.

When the developer roller 43C is rotated at 1200 rpm by a motor 40 shown in FIG. 5, a portion of the liquid developer 14C is lifted to the upper portion of the roller 43C along the outer peripheral surface of the roller 43C. The thus lifted liquid developer 14C mostly abuts the edge portion 52C of the overflow means 47C, and then flows over the overflow means 47C through an overflow slit 53C provided in the overflow means 47C at a portion adjacent to the edge portion 52C. The thus flowing liquid developer 14C overflowing over the overflow means 47C develops the latent image on the major surface of the film 1 when the processor table 26 moves to bring the overflowing liquid developer into contact with the film major surface. The developer roller 43C and the overflow means 47C are preferably made of an insulating synthetic resin such as polyacetal. On a portion of the overflow means 47C adjacent to the slit 53C is attached a developer electrode 55C having a thickness of 0.1 mm, a width of 5 mm and a length of 23 mm, as shown clearly in FIG. 10, in a manner such that the electrode 55C is electrically insulated from the apparatus and can be electrically connected to the overflowing liquid developer 14C. As is apparent from FIG. 10, the developer electrode 55C has a relatively large horizontal surface facing the film 1 upon the movement of the processor table 26. Therefore, the liquid developer 14C overflowing over the overflowing means 47C passes over the horizontal surface of the electrode 55C before the overflowing liquid developer falls back into the container 42C, when the film 1 is positioned over the horizontal surface of the overflow means 47C. Therefore, the electrode can effectively work for developing the latent image on the film 1.

Figure 8:
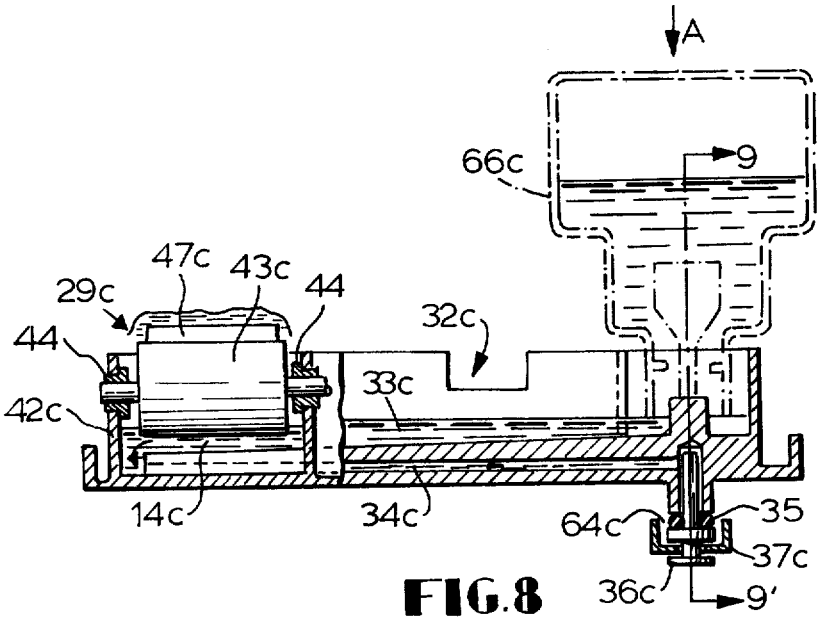
FIG. 8 is a cross-sectional view taken along the line 8—8' of FIG. 6.

After the developing processes, the concentration of the liquid developer 14C in the container 42C decreases. With such a reduced concentration liquid developer, a sufficiently dense image is difficult to develop from latent images. Therefore, it is preferable to remove such a used liquid developer and supply a new liquid developer in an amount corresponding to the amount removed. FIG. 8 shows a mechanism to achieve such a preferred operation. The developer unit 29C further comprises a developer supply passage 33C, a developer discharge passage 34C, a discharge valve stem 36C, and an O-ring 35, and is provided with an exhaust valve 64C which is operated by a discharge lever 37C. According to the arrangement of FIG. 8, the liquid developer 14C supplied from a liquid developer bottle 66C is fed to the container 42C through the developer supply passage 33C. The thus supplied and fed liquid developer 14 is lifted over the overflow means 47C and is thus used for the developing step. After the development, the reduced concentration-liquid developer is removed from the developer unit 29C through the developer discharge passage 34C when the exhaust valve 64 opens. The bottom surfaces of the developer passages 33C and 34C in the container 42C are inclined by about 2° to 5° relative to a horizontal plane, so as to effectively cause the liquid developer to flow through the container 42C.

Figure 9:
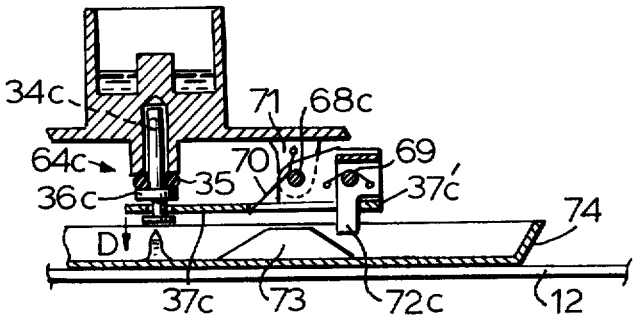
FIG. 9 is a cross-sectional view taken along the line 9—9' of FIG. 8.

FIG. 9 shows a portion of the arrangement of FIG. 8, to show how the exhaust valve is operated. Referring to FIG. 9, the discharge lever 37C is pivotable around an exhaust lever pivot 68C, and urges the discharge valve stem 36C upwardly. The pivot 68C is supported by a pivot support 71 provided on the developer unit 29C. On a portion of the discharge lever 37C is mounted a pivot 69, and an exhaust lever actuator 72C is pivotally mounted on the pivot 69. The exhaust lever actuator 72C basically can pivot in a vertical plane around the pivot 69 relative to the discharge lever 37C, but a further counterclockwise pivoting thereof beyond the position shown in FIG. 9 causes it to abut an edge portion 37'C of the discharge lever 37, which portion is adjacent a side surface of the actuator 72C as shown. On an inside and bottom surface of a housing of the apparatus 12, an exhaust lever saucer 74 having a projection plate 73 fixed therein is provided at a position for the saucer 74 to receive liquid developers from the exhaust valve 64C.

When the processor table 26 starts moving rightward in FIG. 4 from the first position shown in FIG. 4, the exhaust lever actuator 72C engages the projection plate 73. When the processor table 26 moves further rightward, the actuator 72C is pivoted clockwise around the pivot 69. This clockwise pivoting of the actuator 72C does not actuate the discharge lever. On the other hand, when the processor table 26 returns from the second position (rightmost position as seen in FIG. 4) to the first position (original position), namely when the actuator 72C moves leftward in FIG. 9 relative to the projection plate 73, the actuator 72C engages the projection plate 73, and is moved counterclockwise. However, this movement brings it into contact with the edge structure 37'C of the discharge lever 37C as shown in FIG. 9. The discharge lever 37C is then caused to pivot in a direction D, shown in FIG. 9, around the exhaust lever pivot 68C. Consequently, the discharge valve stem 36C is pulled down to exhaust, through the exhaust valve 64C, the liquid developer which has passed through the developer discharge passage 34C, to the saucer 74.

The projection plate 73, especially the length of the top flat portion thereof, is so designed as to exhaust a predetermined amount of the liquid developer into the saucer. The bottom edge of the liquid developer bottle 66C is designed to just contact the surface of the liquid developer in the developer supply passage 33C. Thus, when the amount of the liquid developer is reduced due to the exhausting of a portion thereof to the saucer 74, which reduction lowers the surface level of the liquid developer in the passage 33C to produce a level difference between the bottom edge of the bottle 66C and the surface level of the developer in the passage 33C, the liquid developer bottle 66C automatically supplies an amount of the liquid developer to the passage 33C just necessary to maintain contact of the liquid developer surface in the passage 33C with the bottom edge of the bottle 66C. In the above described manner, the movement of the processor table 26 is utilized for removing a used liquid developer from a developer unit in such a way that a predetermined amount of liquid developer is removed once during each reciprocal movement of the processor table 26 in the housing 12.

FIG. 5 is a top plan view of a main portion of the processor table 26 and other elements mounted on the table 26. Referring to FIG. 5, the processor table 26 is guided on the pair of guide rods 31 to move leftwardly and rightwardly. On the processor table 26 are arranged the charger 27, the exposure window 28, the film kicker 15, plural developer units 29Y, 29M and 29C, the dryer 30, and a motor 40 for driving the developer units 29Y, 29M and 29C. The rotational force of the motor 40 is transferred to a pulley 50 via a belt 49, whereby a gear 51 integral with the pulley 50 rotates. The gear 51 is brought into meshing engagement with one of gears 45Y, 45M and 45C, so as to rotate one of developer rollers 43Y, 43M and 43C, respectively, for developing corresponding latent images. In FIG. 5, the gear 51 is meshing with the gear 45Y provided on the shaft of the developer roller 43Y for yellow development. Thus, when the motor rotates, the yellow liquid developer flows over the overflow means 47Y for performing yellow color development. On the other hand, for performing magenta or cyan color development, the relative position of the motor 40 is shifted leftward in FIG. 5 relative to the processor plate 26 so as to cause the gear 51 to engage with the gear 45M or 45C while the motor 40 is not rotating. By thereafter rotating the motor 40, the desired development for magenta or cyan can be performed just as in the case of yellow.

According to an embodiment of this invention, the reciprocal movement of the processor table 26 in the housing is used for automatically switching (a) developer units to be operated, (b) color filters to select the color images to be projected on the film of a film unit, and (c) the ON-OFF condition of the motor 40. These automatic switchings will now be described in detail with reference to FIGS. 11 to 15. FIG. 11 shows various elements provided on and under the processor table 26, and shows the moment immediately after the apparatus has started its operation. FIG. 12 is a front view of a disk 75 and a slide plate 41 of FIG. 11 seen from the direction of the arrow T. FIG. 13 is a front view of a pawl wheel 76 and a pawl wheel actuator 77 of FIG. 11 seen from the direction of the arrow T. FIGS. 14 and 15 shows moments, respectively, just before the completion of a first reciprocal movement and a second reciprocal movement, respectively, of the processor table 26.

On the slide plate 41 is a plurality of guide pins 79. These pins 79 are guided along guide slots 102 in tabel 26 so that the slide plate 41 can move leftwardly and rightwardly. One side of the slide plate 41 has a rack 80 which is in meshing engagement with a gear 81 which in turn is meshed with a gear 78 coaxially fixed to the shaft of the filter disk 18. The filter disk 18 has three openings in which blue, green and red filters 82, 83 and 84 are mounted. The slide plate 41 further has a steel ball 86 which is urged against the processor table 26 by a resilient plate 87, and which can engage in position setting holes 85Y, 85M and 85C in table 26 so as to set the position of the slide plate 41 relative to the processor table 26. The distances between the holes 85Y and 85M and between the holes 85M and 85C are designed to be equal to the distances, respectively, between the centers of the rotational shafts of the developer rollers 43Y and 43M and between rollers 43M and 43C as shown in in FIG. 7. The engagement of the ball 86 in each hole 85Y, 85M and 85C is released by a sufficiently strong force applied to the slide plate 41 when the plate 41 is stopped by pins during movement of the table to cause it to move relative to the table 26.

The motor 40 shown in FIG. 5 is fixed to a motor base plate 88 which in turn is fixed to the slide plate 41. The pulley 50 and the gear 51 are pivotably mounted on the motor base plate 88 on a stem 89 and an extension plate 89. Therefore, the gear 51 to which the rotational force of the motor 40 is transferred through the belt 49 can move leftwardly and rightwardly on and relative to the processor table 26 together with the slide plate 41. In the state shown in FIG. 11, the steel ball 88 for setting the position of the slide plate on and relative to the processor table 26 is engaged with the hole 85Y provided in the processor table 26. In such state, the gear 51 of FIG. 5 is in meshing engagement with the gear 45Y, and the blue filter 82 is positioned at the exposure window 28 provided in the processor table 26.

Referring in detail to FIGS. 11 and 12, a disk 75 is fixed to a shaft 91 and has upstanding pins 93 and 94 and projection plates 92 and 104 thereon and a gear 95 is also fixed to the shaft 91. The shaft 91 is rotatably supported by a boss 97 fixed to the housing of apparatus 12. The pawl wheel 76 has a gear 90 integral therewith, and they are rotatable around a shaft 99. For transferring the rotational force of the pawl wheel 76 to the disk 75, a gear 96 is provided in meshing engagement with both the gears 90 and 95 as shown. A lever 100 is provided to abut the pawls of the pawl wheel 76 in a manner such that the lever 100 functions as a stop for preventing the rotations of the pawl wheel 76 and the disk 75 in the direction opposite to that shown by the arrows in FIG. 11. The disk 75 and the pawl wheel 76 are provided at a position near the rightmost end of the housing 12 for preventing switching of the meshing engagements of the gear 51 with the gears 45Y, 45M and 45C while the developing step is being performed.

When the developer unit 29Y is carried rightwardly by the processor table 26 to position the slit 53Y of the overflow means 47Y under the leading edge of the surface of the film 1 after the charging step and the exposure step, the side edge of a cam plate 107 on the table 26 pushes the actuator of a microswitch 108 fixed to the housing of apparatus 12 so as to switch the microswitch 108 to its ON state. Thereby, the motor 40 electrically coupled to the microswitch 108 starts rotating, and thus the developer roller 43Y starts rotating. Consequently, the yellow liquid developer 14Y flows over the overflow means 47Y so as to perform yellow color development. When the cam plate 107 is moved out of contact with the actuator of the microswitch 108 by a further rightward movement of the processor table 26, the motor 40 stops its rotation, and hence the yellow color developing operation is stopped.

After the development, the leading edge of the processor table 26 moves rightwardly to a rightmost position 110 (second position) shown by a two-dot-dash line in FIG. 11. However, the leading edge of the slide plate 41 abuts the pin 93, so that a further rightward movement of the slide plate 41 beyond the abutting point is prevented by the pin 93. Therefore, upon the movement of the processor table 26 to the position 110, the slide plate 41 moves in the direction of the arrow F relative to the processor table 26 until the steel ball 86 becomes engaged in the hole 85M after being forced out of the hole 85Y by the leftward moving force of the slide plate 41 relative to the processor table 26.

By this relative leftward movement of the slide plate 41, the gear 81 meshed with the rack 80 of the slide plate 41 rotates in the direction shown by the arrow, and hence the gear meshed with the gear 81 rotates in the direction shown by the arrow, whereby the filter disk 18 rotates ⅓ of a rotation to position the green filter 83 at and under the exposure window 28. At the same time, the gear 51 of FIG. 5 is moved into meshing engagement with the gear 45M. Moreover, as shown in FIG. 12, a swing lever 113 is mounted on a pivot 116 provided on the slide plate 41 and is thus pivotable around the pivot 116 under the control of a resilient plate 117. On the swing lever 113, are pins 114 and 115. Upon the movement of the processor table 26 to the rightmost position 110, the pin 114 is guided by the projection plate 92, so as to move the swing lever in the direction shown by the arrow A in FIG. 11.

When the processor table 26 returns leftward from the position 110, the pawl wheel actuator 77 pivotably mounted under the processor table 26, which actuator 77 is not pivotable in the counterclockwise direction from the position shown in FIG. 13, is engaged with a portion of a pawl wheel 76. A further leftward movement of the processor table 26 causes the pawl wheel to pivot in the direction shown by the arrow in FIG. 11 through 1/6 rotation. Here, the rotational ratio of the gear 95 to the gear 96 is designed to be 1:1, and the rotational ratio of the gear 95 (or 96) to the gear 90 is designed to be 2:1. Therefore, the disk 75 is also pivoted in the direction of the arrow through ⅓ rotation. FIG. 14 shows the state just before the completion of one such reciprocal movement of the processor table 26. In the state of FIG. 14, the gear 51 to transfer the rotational force of the motor 40 to developer units is meshed with the gear 45M for magenta color development, the green filter 83 is positioned just under the exposure window 28, and the steel ball is engaged in the hole 85M. The cam plate 107 is positioned on the processor table 26 at a position shifted from the relative position of FIG. 11 by a distance equal to the distance between the centers of the developer rollers 45Y and 45M.

When the processor table 26 again moves rightward after the above one reciprocal movement, a charging step, an exposure step using the green filter, and a magenta development step are performed in this recited order just as in the manner described above for yellow development. However, in this case, the relative position of the cam plate 107 is shifted from the position of FIG. 11, so that the microswitch 108 operates when the developer roller 43M is brought under the film 1, not when the developer roller 43Y is brought under the film 1. After the magenta development, the processor table 26 moves to the position 110 (second position). Just as in the above described case, the slide plate 41 is abutted against the pin 93 which has been leftwardly shifted by the ⅓ rotation of the disk 75, before the processor table 26 arrives at the position 110. Since the rotation of the disk 75 in the direction opposite to that of the arrow is prevented by the lever 100 abutting on a pawl of the pawl wheel 76, the slide plate 41 does not move rightward further than the position of the pin 93, so that the slide plate 41 moves in the direction of the arrow G relative to the processor table 26 so as to move the steel ball 86 out of the hole 85M and to engage the steel ball 86 in the hole 85C, as understood from FIG. 14.

The distance between the position of pin 93 of FIG. 11 and in FIG. 14 measured in the direction of the movement of the processor table 26 due to the ⅓ rotation of the disk 75 is so designed as to be equal to the distance between adjacent holes 85Y, 85M and 85C, and hence the distance between adjacent developer rollers 43Y, 43M and 43C. Simultaneously with the relative movement of the slide plate 41 in the direction of the arrow G, the filter disk 18 rotates ⅓ rotation in the direction of the arrow, so as to position the red filter 84 under the exposure window 28. When the processor table 26 returns leftward after the drying step, the pawl wheel 76 is rotated 1/6 rotation, and the disk 75 is rotated ⅓ rotation in the direction of the arrow, just as in the above case of the first reciprocal movement of the processor plate 26. FIG. 15 shows the state just before the completion of the second reciprocal movement of the processor table 26.

After the second reciprocal movement of the processor table 26, it again moves rightward to perform a charging step, an exposure step through the red filter, a cyan development step, and a drying step in this recited order, just as in the above case for magenta development (second reciprocal movement). Referring to FIG. 15, upon the movement of the processor table 26 up to the position 110, the pin fixed to the swing lever 113 is guided by the projection plate 104 to move the swing lever 113 in the direction of the arrow B. At the time of this movement, the pin 94 on the disk 75 is at a position to be abutted by the slide plate 41, which position is the same as that of the pin 93 in FIG. 14. Thus, just as in the case of FIG. 14, the slide plate 41 does not further move rightward than the relative position shown in FIG. 15. When thereafter the processor table 26 returns leftward from the rightmost position (second position), the pawl wheel 76 is rotated in the direction of the arrow to return to the initial rotational position as shown in FIG. 11.

A further leftward movement of the processor table 26 causes a pin 115 provided on an edge portion of the swing lever 113 (which has been pivoted in the direction of arrow B) to abut a stop 120. A still further movement of the processor plate 26 causes the slide plate 41 to be blocked while the table continues to move, so that plate 41 moves rightward in the direction of arrow E relative to the processor table 26 for disengaging the steel ball 86 from the hole 85C and for engaging the steel ball 86 back into the initial hole 85Y where the processor table 26 is positioned at the leftmost position (first position). Simultaneously with this relative movement, the filter disk 18 is also rotated in the direction of the arrow so as to again position the blue filter 82 under the exposure window 28. Thereby, the processor table 26, the slide plate 41 and the filter disk 18 are brought back to the initial relative positions as shown in FIG. 11, whereby the third reciprocal movement of the processor table 26 is completed.

In the leftward (backward) movement in each of the first and the second reciprocal movements of the processor table 26, the pin 115 is not positioned at a relative position to abut the stop 120. Therefore, the slide plate 41 is not blocked by the 120 in the first and the second reciprocal movements of the processor table 26. Further, in the backward movement in the third reciprocal movement of the processor table 26, the swing lever 113 is moved in the direction B as described above. Therefore, a projection 121 on the swing lever 113 pushes a side portion of an intermediate lever 122 pivotally mounted on a pivot 123 to cause the intermediate lever 122 to pivot in the direction of the arrow against the spring force of a spring 124 connected thereto.

On the processor table 26 is further fixed a pivot 119 on which a film kicker 15 is pivotally mounted for movement in a vertical plane as shown in FIGS. 4 and 16. In the non-operative state of the film kicker 15, the film kicker 15 is positioned at a position as shown by the solid lines in FIG. 16. However, upon pivotal movement of the intermediate lever 122 the edge 125 thereof pushes an end portion 15'' of the film kicker 15, and the film kicker 15 is pivoted to a position as shown by the dot-dash lines in FIG. 16. When the processor table 26 moves leftward in FIG. 16 with the film kicker 15 in the position shown by the dot-dash lines, the other end portion 15' of the film kicker 15 engages the film unit 3, and a further leftward movement of the processor table 26 moves the film unit 3 out of the processing position 23 to the outlet 62 in FIG. 4.

By the movement of the processor table 26 to its initial leftmost position, the slide plate 41 is moved relative to the processor table back to its initial position as shown in FIG. 11. Thus the intermediate lever 122 is returned to its initial position by the spring force of the spring 124, and thus the film kicker 15 also returns to its initial position as shown by the solid lines in FIG. 16, whereby all the elements in the apparatus are then positioned at the initial positions thereof.

Referring finally to FIGS. 16 and 17, these drawings mainly show a finder means usable in the apparatus of this invention. FIG. 16 is a right side view of a portion of the apparatus of FIG. 1, and FIG. 17 is a schematic left side view of the portion of the apparatus shown in FIG. 16. In FIG. 16, reference numerals 131, 132 and 133 designate a finder lens, a mirror and a focusing plate, respectively. The arrangement is designed for an operator to focus an image from the original 19 on the focusing plate 133 by observing, through the finder lens 131, the image on the focusing plate 133 through the lens unit 25 of FIG. 4, and by moving the lens unit 25.

After the focusing operation, a film unit 3 is carried to the processing position 23 by the feeder lever 22. Once the film unit 3 is positioned at the processing position 23, the film 1 of the film unit 3 is required to be shielded against any light which might enter the apparatus through the finder lens 131. For the purpose of such shielding, a first finder cover 134 and a second finder cover 135 are provided. One end of the second finder cover 135 is engaged with an end portion of the feeder lever 22, and the second finder cover 135 can freely move to positions A, B and C in FIG. 17. The first finder cover 134 is engaged at its end portion with an end portion of a lever 138 for actuating the first finder cover 134, and is tensioned to the right in FIG. 17 by a spring 136. The first finder cover 134 can move to positions A and B.

The A position in FIG. 17 is the position of the finder lens 131. When either the first or the second finder cover 134 or 135 is positioned at the A position, light from outside coming through the finder lens 131 is blocked by the first or the second finder cover which is then positioned at the A position. The lever 138 is pivotally mounted on a pivot 141 fixed to the processor table 26, and has a pin 139 fixed at an end portion thereof. The pin 139 is connected to a spring 142, as shown in FIG. 17, so that the pin 139 and the lever 138 are stationarily positioned at the positions shown by the solid lines in FIG. 17, when they are not supplied with any further force from outside. Further, the motor base plate 88 fixed to the slide plate 41 is provided with a pressure plate 140. The pressure plate 140 thus moves together with the slide plate 41. Reference numerals 140Y, 140M, 140C in FIG. 17 designate positions of the pressure plate 140, when the steel ball 86 on the slide plate 41 is engaged in the hole 85Y, by the hole 85M, and by the hole 85C, respectively. The pressure plate 140 is designed to be engageable with the pin 139, only when the pressure plate 140 is positioned at the 140Y position.

Next, the first and the second finder covers 134 and 135 will be described with reference to FIG. 17. When an operator carries out a focusing operation, the processor table 26 is positioned at the initial (first) position, where the steel ball 86 is engaged in the hole 85Y. At that time the pressure plate 140 is positioned at the 140Y position, and abuts the pin 139. Therefore, the lever 138 cannot pivot in the clockwise direction from the rotational position shown in FIG. 17. Thus, the lever 138 keeps the first finder cover 134 at the B position against the spring force of the spring 136. At this time, the second finder cover 135 is positioned at the C position, not at the A position. Thus, the operator can carry out the focusing operation by observing the focusing plate 133 through the finder lens 131.

When a film unit 3 is fed to the processing position 23 by the feeder lever 22 after the focusing operation, the second finder cover 135 is brought to the A position from the C position by being pushed by the feeder lever 22. Thereby, light coming through the finder lens 131 which would otherwise reach to the film unit 3 is shielded by the second finder cover 135. When next the processor table 26 starts moving rightward, the lever 138 also moves together therewith, so that the finder cover 134 is brought to the A position from the B position by the spring force of the spring 136, while the second finder cover 135 is pushed by the first finder cover 134 to the C position from the A position. Therefore, while the processor table 26 is in its rightward movement, the finder cover 134 acts as a shield plate at the A position. When the processor table 26 is brought to the initial position after the first reciprocal movement thereof, the slide plate 41 is shifted from the initial position to a new position where the steel ball 86 is engaged in the hole 85M. At this time, the pressure plate 140 is at the 140M position, where the lever is pivotable both clockwise and counterclockwise. Therefore, the top end of the lever 138 passes the end portion 145 of the finder cover 134, and the finder cover 134 is still positioned at the A position.

When the processor table 26 is then moved rightward again, the lever 138 passes the end 145 of the finder cover 134. When the processor table returns to the initial position again after the second reciprocal movement thereof, the pressure plate 140 is positioned at the 140C position, and the finder cover 134 is positioned still at the A position. However, when the processor table 26 returns to the initial position after the third reciprocal movement thereof, the slide plate 41 is brought to its initial position, where the steel ball 86 is engaged in the hole 85Y. Thus, the pressure plate 140 is shifted from the 140C position to the 140Y position. In this state, at the position where the lever 138 abuts the end portion 145 of the finder cover 134, the pressure plate 140 abuts the pin 139, so that the lever cannot pivot further clockwise. Thus, upon the movement of the processor table 26, the lever 138 moves the finder cover 134 from the A position to the B position against the spring force of the spring 136. On the other hand, the second finder cover 135 is still positioned at the C position because it is not supplied with any force from outside. Therefore, after the completion of the third reciprocal movement of the processor table 26, an operator can observe the focusing plate 133 through the finder lens 131.

As is apparent from the foregoing description, this invention or the above described embodiment of the apparatus of this invention has various features and advantages which will be summarized below.

The apparatus comprises a charger, an exposure unit and plural developer units necessary for electrophotographically producing color images. Color images are produced by the reciprocal movements of the processor table. In one reciprocal movement thereof, a sequential process of charging, exposing and developing is performed. By switching, for respective reciprocal movements, color filters and developer units to be operated, full-color images of an original can be produced on an electrophotographic film. Therefore, the above apparatus can be much smaller in size and much more inexpensive than an apparatus which comprises three sets of devices each set comprising a charger, an exposure unit and a developer unit, and in which the color image production is performed by only one reciprocal movement of a processor table.

Since developer rollers and overflow means are used for developing latent images, the switching among developer units to be operated can be done merely by switching the connections of a motor with respective developer rollers. Such switching can be easily performed by simply switching gear connections, so that the apparatus can be made compact in size and inexpensive. Further, the developer units to be operated are switched in every reciprocal movement of the processor table, and the color filters are switched, together with the switching of the developer units, to position a necessary color filter under the exposure window. Thus, the necessary combinations of a blue filter, a green filter and a red filter with yellow development, magenta development and cyan development, respectively, can be easily achieved. Further, a single common rotational power source can be easily used for achieving such necessary combinations.

The slide plate which functions as a main component for switching the developer units to be operated controls the ON-OFF switching of the motor for driving developer rollers to carry out development only when each developer unit is brought to a position under the film held at a predetermined position. In this case, the timing of the operation of respective developer units, i.e. the relative positions of the developer units at which the start and stop of the the overflowing of the respective liquid developers occurs, can always be kept constant. By operating the driving motor in only such a limited period, the apparatus can substantially be protected from being stained by the liquid developers, and is much more advantageous than an apparatus in which the developer units are always operated throughout the movements or operations of the processor table.

By a simple construction and operation for pivotally moving the swing plate provided on the slide plate, the slide plate can be brought to its initial position (the position where the gear 51 is meshed with the gear 45Y in the above embodiment) after completion of color image production. Thus, switching of plural developer units can be easily and automatically repeated. Further, by the pivotal movements of the swing lever, the film kicker can be brought to a position to abut the film unit only upon the backward movement of the processor table in the last reciprocal movement, whereby the film unit having a produced color image can be kicked out of the apparatus without fail. Further, the apparatus is constructed in such a manner that the film kicker pushes the film unit out only after the slide plate is ready to return to its initial position. Thus, after the kicking out of the film unit, the slide plate is positioned at its initial position without fail.

Furthermore, according to the apparatus of this invention, a color image can be produced even from a black/white original by interrupting the supply of electric power to the motor after one or two steps among yellow, magenta and cyan developments.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true sprit and scope of the invention.

What is claimed is:

1. An electrophotographic color image producing apparatus for producing on an electrophotographic film a color image of an original, comprising:

a housing film unit holding means supported by said housing for holding at a processing position a film unit comprising an electrophotographic film having a major surface facing downwards;

processing means arranged in said housing for processing an image on said major surface of said film, said processing means comprising a charger for applying a uniform electrostatic charge on said major surface of said film, an exposure unit for applying light from an original to the charge-bearing major surface of said film to form a latent image, n developer units (n being an integer larger than 1) each containing a liquid developer for developing said latent image to a visible image, and a dryer for drying the visible image-bearing major surface of said film, said exposure unit including a lens unit supported by said housing for focusing said light from the original on said charge-bearing major surface of said film;

a processor table slidably mounted in said housing and reciprocally movable along a horizontal path under said major surface of said film between a first position and a second position, said processor table having said dryer, said plural developer units and said charger mounted thereon in this recited order in the direction from said first position to said second position so that each of said charger, said plural developer units and said dryer passes said processing position for said film unit in this recited order upon the movement of said processor table for performing the charging step, the exposing step, the developing step and the drying step at said processing position in this recite order;

driving means coupled to said processor table for reciprocally moving said processor table between said first position and said second position; and developer operating means for being selectively coupled to the mth one of said n developer units (m being an integer defined by $1 \leqq m \leqq n$) for operating said mth developer unit to apply said liquid developer in said mth developer unit to said major surface of said film when said mth developer unit is positioned at said processing position in an mth reciprocal movement of said processor table, and in one reciprocal movement of said processor table, for being released from said mth developer unit, and for then being coupled to an (m+1)th developer unit for operating said (m+1)th developer unit to apply said liquid developer in said (m+1)th developer unit to said major surface of said film when said (m+1)th developer unit is positioned at said processing position in an (m+1)th reciprocal movement of said processor table;

whereby during n reciprocal movements of said processor table between said first and said second position, n cycles each constituting a charging step, an exposing step, a developing step and a drying step are performed for the respective liquid developers in said n developer units for producing a color image on said major surface of said film.

2. Apparatus according to claim 1, wherein said film unit comprises a film mount with an aperture having said film mounted therein.

3. Apparatus according to claim 1, wherein said developer units comprise: a vessel with (n−1) partition walls forming n containers; n liquid developers contained in said n containers, respectively; n developer rollers a corresponding rotatably mounted in each container with a lower portion thereof being immersed in the liquid developer; and n overflow means a corresponding mounted in each container to slidably contact an upper portion of each developer roller for allowing the liquid developer to flow over each overflow means, the thus overflowing liquid developer being adapted to contact said major surface of said film.

4. Apparatus according to claim 3, wherein said developer operating means includes a motor; a rotation transfer device coupled to said motor for transferring the rotational force of said motor to one of said developer rollers; and a switching device coupled to said processor table and said rotation transfer device for coupling said rotation transfer device to said one of said developer rollers upon one reciprocal movement of said processor table, and for coupling said rotation transfer device to a subsequent one of said developer rollers upon a subsequent reciprocal movement of said processor table.

5. Apparatus according to claim 4, wherein said developer operating means includes: a disk pivotably mounted on said housing and having a pin thereon, said disk being intermittently rotated by reciprocal movements of said processor table; and a slide plate mounted on said processor table and slidable in the direction of the movement of said processor table and having said motor fixed thereto, said slide plate abutting said pin upon the movement of said processor table for shifting the position of said slide plate relative to said processor table in order to switch the coupling between said rotation transfer means and said one of said developer rollers to the coupling between said rotation transfer means and said subsequent one of said developer rollers.

6. Apparatus according to claim 5, wherein said switching device comprises means for switching the coupling between said rotation transfer means and said one of said developer rollers to the coupling between said rotation transfer means and said subsequent one of said developer rollers when said processor table is moved close to said second position on the way from said first position to said second position in said one reciprocal movement of said processor table, and for switching the coupling between said rotation transfer means and a last one of said developer rollers to the coupling between said rotation transfer means and an initial one of said developer rollers upon the movement of said processor table from said second position to said first position in a last reciprocal movement of said processor table.

7. Apparatus according to claim 6, wherein said exposure unit comprises: an exposure window provided in said processor table; and a filter disk having thereon plural color filters corresponding to said plural developer units, said filter disk being intermittently rotated by the movement of said processor table for positioning one of said color filters at said exposure window.

8. Apparatus according to claim 7, wherein said filter disk has a gear integral therewith which gear is meshed with a rack provided on a side surface of said slide plate so as to intermittently rotate said filter disk in correspondence with the switching of the couplings between said rotation transfer means and said developer rollers.

9. Apparatus according to claim 8, wherein said motor is supplied with an electric power through electrical switch which is actuated by said slide plate upon movement of said slide plate in a manner such that said electrical switch is kept in the ON-state only when the developer unit the developer roller of which is coupled with said rotation transfer device passes under said major surface of said film.

10. Apparatus according to claim 7, wherein said motor is supplied with electric power through an electrical switch which is actuated by said slide plate upon movement of said slide plate in a manner such that said electrical switch is kept in the ON-state only when the developer unit the developer roller of which is coupled with said rotation transfer device passes under said major surface of said film.

11. Apparatus according to claim 6, wherein said motor is supplied with electric power through an electrical switch which is actuated by said slide plate upon movement of said slide plate in a manner such that said electrical switch is kept in the ON-state only when the developer unit the developer roller of which is coupled with said rotation transfer device passes under said major surface of said film.

12. Apparatus according to claim 5, wherein said exposure unit comprises: an exposure window provided in said processor table; and a filter disk having thereon plural color filters corresponding to said plural developer units, said filter disk being intermittently rotated by the movement of said processor table for positioning one of said color filters at said exposure window.

13. Apparatus according to claim 12, wherein said filter disk has a gear integral therewith which gear is meshed with a rack provided on a side surface of said slide plate so as to intermittently rotate said filter disk in correspondence with the switching of the couplings between said rotation transfer means and said developer rollers.

14. Apparatus according to claim 13, wherein said motor is supplied with electric power through an electrical switch which is actuated by said slide plate upon movement of said slide plate in a manner such that said electrical switch is kept in the ON-state only when the developer unit the developer roller of which is coupled with said rotation transfer device passes under said major surface of said film.

15. Apparatus according to claim 12, wherein said motor is supplied with electric power through an electrical switch which is actuated by said slide plate upon movement of said slide plate in a manner such that said electrical switch is kept in the ON-state only when the developer unit the developer roller of which is coupled with said rotation transfer device passes under said major surface of said film.

16. Apparatus according to claim 5, wherein said motor is supplied with electric power through an electrical switch which is actuated by said slide plate upon movement of said slide plate in a manner such that said electrical switch is kept in the ON-state only when the developer unit the developer roller of which is coupled with said rotation transfer device passes under said major surface of said film.

17. Apparatus according to claim 3, which further comprises: plural liquid developer discharging means corresponding in number to the number of said developer units, each of said discharging means being coupled to a corresponding developer unit for discharging a predetermined amount of the liquid developer from said corresponding developer unit upon the corresponding reciprocal movement of said processor table after the developing step by said corresponding liquid developer; and plural liquid supply means corresponding in number to the number of said developer units, each of said supply means being coupled to a corresponding developer unit for supplying said predetermined amount of the liquid developer to said corresponding developer unit to compensate for the discharged amount of the liquid developer.

18. Apparatus according to claim 1, wherein said dryer comprises means for first supplying hot air to said major surface of said film for a predetermined period, and then for supplying room temperature air to said major surface of said film while said dryer is positioned under said film.

* * * * *